US007525489B2

(12) United States Patent
Ying

(10) Patent No.: US 7,525,489 B2
(45) Date of Patent: Apr. 28, 2009

(54) DIGITAL VIDEO BROADCAST-HANDHELD (DVB-H) ANTENNAS FOR WIRELESS TERMINALS

(75) Inventor: Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 873 days.

(21) Appl. No.: 11/005,845

(22) Filed: Dec. 7, 2004

(65) Prior Publication Data

US 2006/0135061 A1 Jun. 22, 2006

(51) Int. Cl.
*H01Q 1/24* (2006.01)
*H01Q 1/42* (2006.01)

(52) U.S. Cl. ..... 343/702; 343/872

(58) Field of Classification Search ..... 343/702, 343/725, 806, 878, 872
See application file for complete search history.

(56) References Cited

U.S. PATENT DOCUMENTS

2006/0084435 A1* 4/2006 Borsos et al. ..... 455/436
2006/0099993 A1* 5/2006 Leinonen et al. ..... 455/562.1

FOREIGN PATENT DOCUMENTS

WO WO 99/52175 10/1999
WO WO 02/03728 1/2002
WO WO03105386 12/2003

OTHER PUBLICATIONS

"DVB-H: Handheld. IPBroadcasting to Handheld Devices Based on DVB-T" http://www.dvb.org/documents/white-papers/wp07.DVB-H.final.pdf (Apr. 2004).
"DVB-T:Terrestrial. Hierarchical Modulation" http://www.dvb.org/documents/white-papers/WP01%20(DVB-T%20Hierarchical).pdf (Mar. 2000).
Digital Video Broadcasting (DVB); Interaction channel through the Global System for Mobile communications (GSM) European Standard (Telecommunications Series), ETSI EN 301 195 V1.1.1 1-14 (1999) XP-002151800.
Buecken, R.; "Ueberall Zu Hause DVB-H: Wenn Fernsehen and Mobilfunk zusammenwachsen" *Netzbetreiber Und-Dienste* 58:11 49-52 (2004) XP-001213914.
"Digital Video Broadcasting (DVB); Transmission System for Handheld Terminals (DVB-H)" European Standard (Telecommunications series), ETSI EN 302 304 V1.1. 5-6 (2004) XP014026966.
International Search Report for PCT/EP2005/012214; Date of Mailing Mar. 27, 2006.

* cited by examiner

*Primary Examiner*—Shih-Chao Chen
(74) *Attorney, Agent, or Firm*—Myers Bigel Sibley & Sajovec, P.A.

(57) ABSTRACT

An antenna for a wireless terminal can include an antenna configured to be removably coupled to the wireless terminal and configured for display of digital video broadcast data based on received DVB-H compliant signals.

28 Claims, 6 Drawing Sheets

DIGITAL VIDEO BROADCAST-HANDHELD (DVB-H) ANTENNAS FOR WIRELESS TERMINALS

FIELD OF THE INVENTION

The invention generally relates to the field of communications, and more particularly, to antennas, wireless terminals, and mobile terminals incorporating the same.

BACKGROUND

With the emergence of digital television, there has been an effort to develop standards for the broadcast and reception of digital video signals. One such effort is the digital video broadcasting project (DVB) which is a consortium developing standards for television and data services. The DVB project is discussed in detail on the internet at www.dvb.org.

One of the standards being developed by the DVB project is referred to as digital video broadcast-terrestrial (DVB-T). According to the DVB-T standard, hierarchical modulation is used to provide two separate data streams: a high priority stream and a low priority stream. One of the factors in determining whether the low priority stream can be received is the quality of the signal provided to the receiver.

It is known that handheld devices, such as cellular radiotelephones, may have difficulty in providing services via DVB-T type digital video signals because of the power limitations of such devices. In other words, it is known that receivers that comply with the DVB-T standard may consume more power than may easily be provided by cellular radiotelephones. Accordingly, the DVB project developed and promulgated the DVB-Handheld (DVB-H) standard which focuses on reducing the power otherwise required for receivers to process DVB compliant signals. In brief, the DVB-H standard includes variations from the DVB-T standard, such as time slicing and forward error correction to reduce the power requirements of such mobile devices. Notwithstanding the reduced power requirements provided by DVB-H, compliance with the DVB standards discussed above may still require adequate reception of signal to utilize the relatively low priority (i.e., higher bit rate) data streams.

SUMMARY

Embodiments according to the invention can provide digital video broadcast-handheld (DVB-H) antennas for wireless terminals. Pursuant to these embodiments, an antenna accessory for a wireless terminal can include an antenna accessory housing configured to be removably coupled to a wireless terminal configured for display of digital video broadcast data. A DVB-H compliant antenna can be included in the antenna accessory housing and can be configured to receive DVB-H compliant signals.

In some embodiments according to the invention, the wireless terminal is configured to operate with antenna accessory de-coupled therefrom. In some embodiments according to the invention, an antenna accessory can further include a DVB-H compliant receiver, in the antenna accessory housing, which is configured to receive the DVB-H compliant signals and to provide the digital video broadcast data to the wireless terminal. In some embodiments according to the invention, the DVB-H compliant antenna is located proximate an outer wall of the antenna accessory housing.

In some embodiments according to the invention, the wireless terminal is a "stick" or "clam-shell" form-factor wireless terminal. In some embodiments according to the invention, the DVB-H compliant antenna is a multi-plate monopole antenna. In some embodiments according to the invention, the multi-plate monopole antenna includes a plurality of at least partially overlapping plates electrically coupled together in series.

In some embodiments according to the invention, the accessory further includes a plurality of conductors coupled to respective edges of the at least partially overlapping plates. In some embodiments according to the invention, the accessory further includes a plurality of conductors coupled to alternating edges of the at least partially overlapping plates. In some embodiments according to the invention, the alternating edges are alternating shorter edges compared to an adjacent edge of the plurality of the at least partially overlapping plates. In some embodiments according to the invention, the alternating edges are alternating longer edges compared to an adjacent edge of the plurality of the at least partially overlapping plates. In some embodiments according to the invention, the plurality of conductors are coupled to a combination of shorter and longer edges of the at least partially overlapping plates.

In some embodiments according to the invention, the accessory further includes an antenna feed coupled to a first one of the plurality of the least partially overlapping plates, wherein remaining ones of the plurality of the least partially overlapping plates are arranged above the first one according to increasingly larger sizes of the plurality of the least partially overlapping plates to define a pyramid shape for the plurality of the least partially overlapping plates.

In some embodiments according to the invention, the accessory further includes an antenna feed coupled to a first one of the plurality of the least partially overlapping plates, wherein remaining ones of the plurality of the least partially overlapping plates are arranged above the first one according to decreasingly smaller sizes of the plurality of the least partially overlapping plates to define an inverted pyramid shape for the plurality of the least partially overlapping plates.

In some embodiments according to the invention, the accessory further includes an antenna feed coupled to a first one of the plurality of the least partially overlapping plates, wherein remaining ones of the plurality of the least partially overlapping plates are arranged above the first one.

In some embodiments according to the invention, the plurality of at least partially overlapping plates include opposing faces that are spaced about 0.5 mm to about 2.0 mm apart. In some embodiments according to the invention, the spacing between opposing face of the plurality of at least partially overlapping plates is unequal.

In some embodiments according to the invention, the accessory further includes a non-volatile memory configured to store a DVB-H services subscriber identity. In some embodiments according to the invention, the non-volatile memory is a semiconductor based non-volatile memory and/or a subscriber identity module.

In some embodiments according to the invention, the DVB-H compliant antenna is configured to receive DVB-H signals in a range of about 470 Mhz to about 860 Mhz. In some embodiments according to the invention, the wireless terminal comprises a cellular radiotelephone. In some embodiments according to the invention, the wireless terminal comprises a "game-controller" form-factor wireless terminal.

In some embodiments according to the invention, a cellular radiotelephone can include a cellular radiotelephone housing and a cellular radiotelephone transceiver in the housing. A processor circuit is configured to coordinate operation of the cellular radiotelephone including the cellular radiotelephone transceiver. A Digital Video Broadcast-Handheld (DVB-H) interface is configured to allow removeable coupling of a DVB-H compliant antenna module to receive DVB-H compliant signals.

In some embodiments according to the invention, a non-volatile memory in the housing is configured to store a subscriber identifier to allow display of digital video broadcast data based on the received DVB-H compliant signals on a display of the cellular radiotelephone. In some embodiments according to the invention, the DVB-H interface is configured to allow transmission of DVB-H baseband data and/or DVB-H radiofrequency data from the DVB-H compliant antenna module to the cellular radiotelephone.

In some embodiments according to the invention, a non-volatile memory in the radiotelephone is a removeable subscriber identity module. In some embodiments according to the invention, the non-volatile memory is further configured to allow display of digital video broadcast data based on received DVB-H compliant signals including a subscription based video channel. In some embodiments according to the invention, the cellular radiotelephone is a 3GPP compliant cellular radiotelephone.

In some embodiments according to the invention, an antenna for a wireless terminal can include a Digital Video Broadcast-Handheld (DVB-H) compliant antenna configured to receive DVB-H compliant signals comprising a multi-plate monopole antenna.

DESCRIPTION OF EMBODIMENTS ACCORDING TO THE INVENTION

Figure 1A:
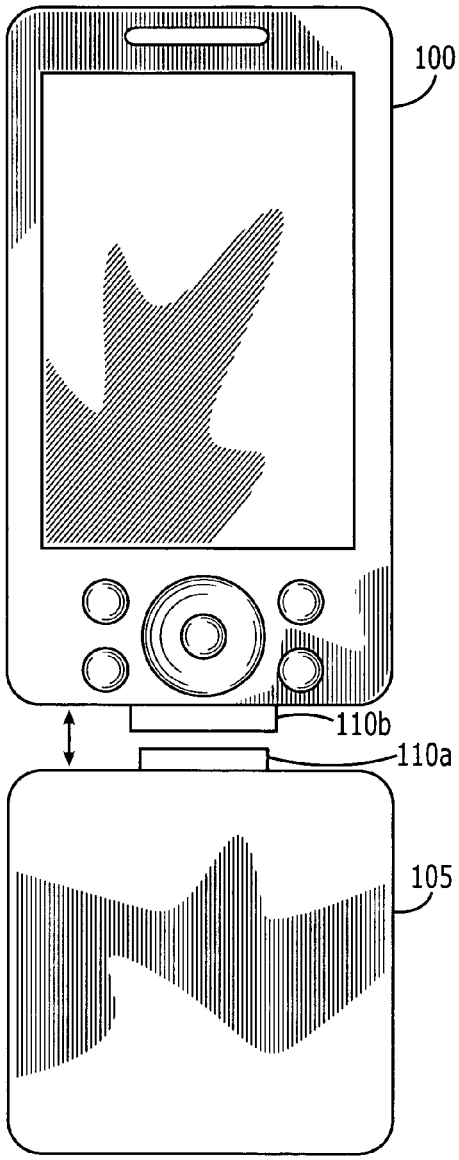
FIGS. 1A and 1B are schematic illustrations of a DVB-H compliant accessory configured to be removeably coupled to wireless terminals, according to some embodiments of the invention.

The invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, when an element is referred to as being "coupled" to another element, it can be directly coupled to the other element or intervening elements may be present. In contrast, when an element is referred to as being "directly coupled" to another element, there are no intervening elements present. Like numbers refer to like elements throughout. It should be emphasized that the term "comprises/comprising" when used in this specification is taken to specify the presence of stated features, integers, steps or components but does not preclude the presence or addition of one or more other features, integers, steps, components or groups thereof.

Spatially relative terms, such as "above", "below", "upper", "lower", "right", "left" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense expressly so defined herein.

Embodiments of the invention are described herein with reference to schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, it will be understood that an antenna described having a "pyramid" shape may be shown as including idealized sharp angles but will, typically, have a rounded or curved angles rather than the idealized angles shown. Thus, the elements illustrated in the figures are schematic in nature and their shapes are not intended to illustrate the actual shape of a region of a device and are not intended to limit the scope of the invention.

As used herein, the term "wireless terminal" may include, but is not limited to, a cellular radiotelephone (or radiotelephone) with or without a multi-line display; a Personal Communications System (PCS) terminal that may combine a cellular radiotelephone with data processing, facsimile and data communications capabilities; a PDA that can include a wireless terminal, pager, Internet/intranet access, Web browser, organizer, calendar and/or a global positioning system (GPS) receiver; and a conventional laptop and/or palmtop receiver or other appliance that includes a wireless terminal transceiver.

Wireless terminals and antenna accessories according to some embodiments of the invention may operate in any of the following bands: DVB, GSM, EGSM, DCS, PDC and/or PCS frequency bands. DVB operation can include transmission/reception in a frequency range of about 470 MHz to about 860 MHz. GSM operation can include transmission in a frequency range of about 824 MHz to about 849 MHz and reception in a frequency range of about 869 MHz to about 894 MHz. EGSM operation can include transmission in a frequency range of about 880 MHz to about 914 MHz and reception in a frequency range of about 925 MHz to about 960 MHz. DCS operation can include transmission in a frequency range of about 1710 MHz to about 1785 MHz and reception in a frequency range of about 1805 MHz to about 1880 MHz. PDC operation can include transmission in a frequency range of about 893 MHz to about 953 MHz and reception in a frequency range of about 810 MHz to about 885 MHz. PCS operation can include transmission in a frequency range of about 1850 MHz to about 1910 MHz and reception in a frequency range of about 1930 MHz to about 1990 MHz. Other bands can also be used in embodiments according to the invention.

In some embodiments according to the invention, an antenna accessory for a wireless terminal can include an antenna accessory housing that is configured to be removeably coupled to a wireless terminal configured to display digital video broadcast data on a display thereof. The antenna accessory includes a digital video broadcast handheld (DVB-H) compliant antenna in the housing and is configured to receive DVB-H compliant signals. Accordingly, a suitably sized DVB-H compliant antenna can be provided in the housing of the antenna accessory rather than in the wireless terminal. As appreciated by the present inventor, the limited space available within the housing of a typical wireless terminal may be so limited that it may be difficult to provide an adequately sized and positioned DVB-H compliant antenna within the wireless terminal without creating an unappealing size as defined by users. Therefore, an antenna accessory according to some embodiments of the invention may be coupled to a wireless terminal when DVB-H compliant services are to be accessed and may be de-coupled when, for example, the wireless terminal is to be used in another capacity such as for cellular radiotelephone communications. In some embodiments according to the invention, the antenna accessory also includes a DVB-H compliant receiver so that digital video broadcast data in a baseband format can be transmitted from the antenna accessory to the wireless terminal over a DVB-H interface used to connect the wireless terminal to the accessory.

As discussed herein below in greater detail, the DVB-H compliant antenna can be a multi-plate monopole antenna including a plurality of at least overlapping plates that are electrically coupled together in series. The multiple overlapping plates of the monopole antenna can be arranged to define general shapes, such as a pyramid or inverted pyramid shape wherein the plurality of overlapping plates are arranged in ascending or descending order according to the size of the individual plates. In still other embodiments according to the invention, other shapes are defined by the overlapping plates by varying the order of the plates.

Figure 1B:
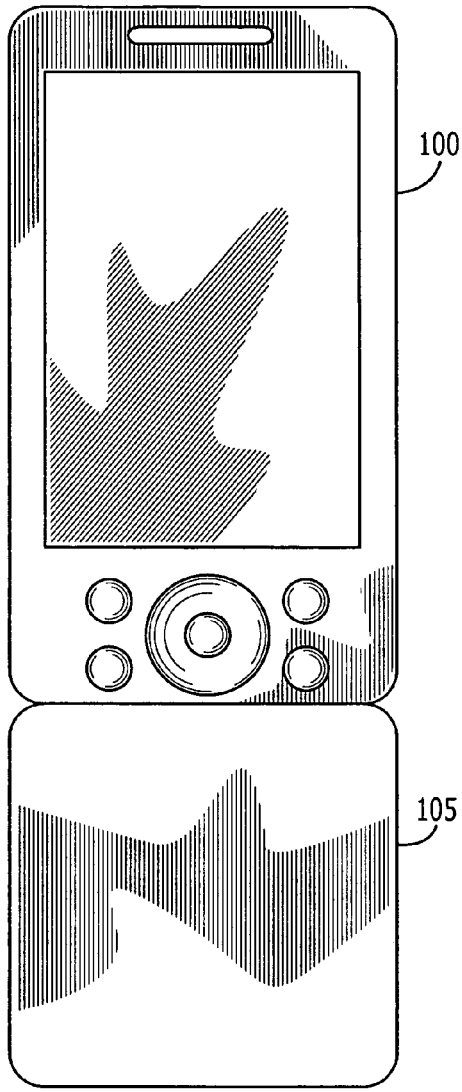

FIGS. 1A and 1B are schematic illustrations of DVB-H compliant antenna accessories 105 configured to be removeably coupled to wireless terminals 100 according to some embodiments of the invention. As shown in FIGS. 1A and 1B, the DVB-H compliant antenna accessory 105 can be decoupled from the wireless terminal 100 so that DVB-H compliant connectors 110A/B are separated from one another. In such a configuration, the wireless terminal 100 may be operated as a wireless terminal and may not otherwise receive digital video broadcast data from the accessory 105.

As shown in FIG. 1B, the accessory 105 can be coupled to the wireless terminal 100 via the respective DVB-H compliant connectors 110A/B. In such a configuration, the accessory 105 is configured to receive DVB-H compliant signals which can be provided to the wireless terminal 100 for display thereon. It will be further understood that the accessory 105 may be repositionable relative to the wireless terminal 100 while coupled thereto to allow improved reception of the DVB-H compliant signals by the accessory 105. For example, in some embodiments according to the invention, the accessory 105 may be rotated relative to the wireless terminal 100 to increase the signal strength of the DVB-H compliant signals received by the accessory 105, which may be monitored by a read-out provided on a display of the wireless terminal 100. It will be understood that when the wireless terminal 100 is coupled to the DVB-H compliant antenna accessory 105, in some embodiments according to the invention, the wireless terminal 100 may operate, for example, as a cellular radiotelephone or display DVB-H compliant signals (or a combination thereof).

Figure 2:
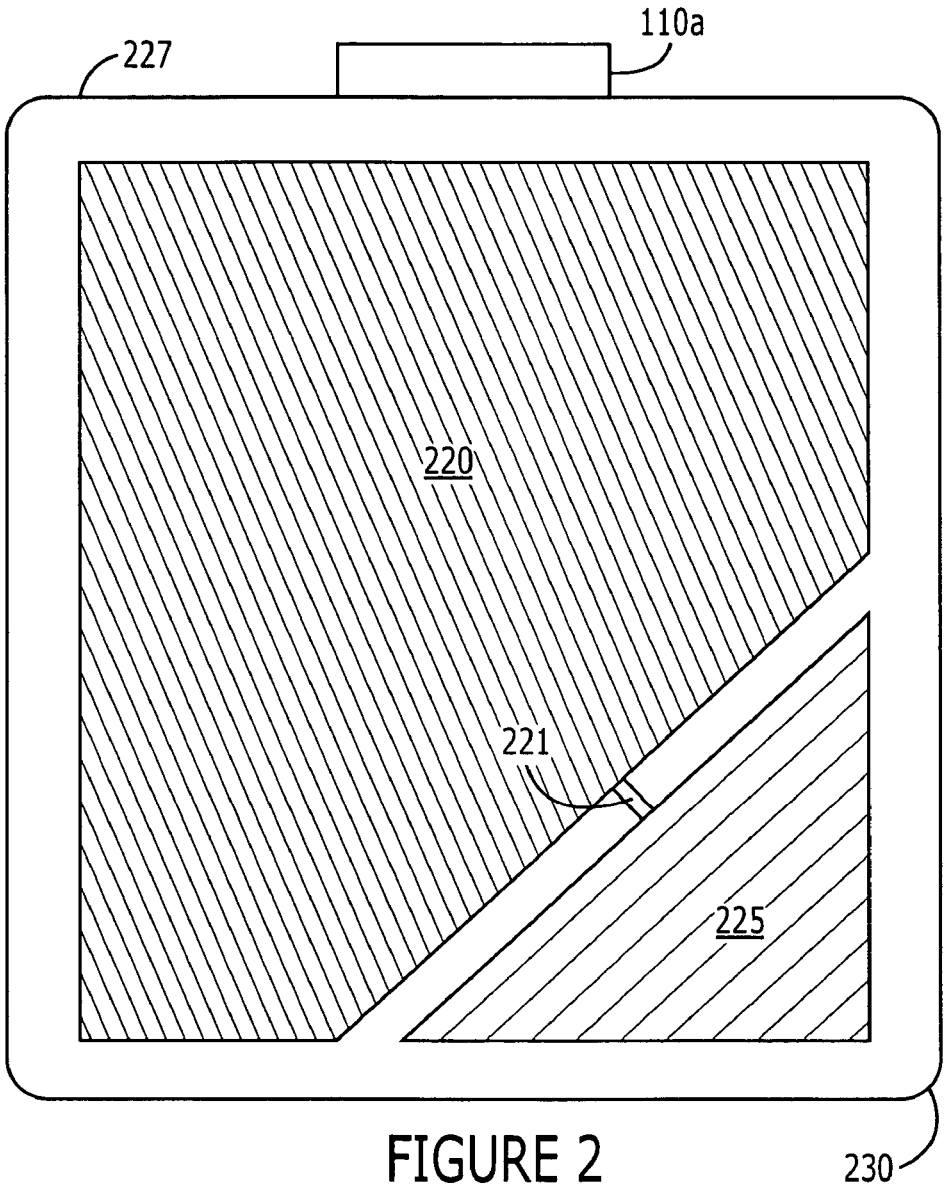
FIG. 2 is a schematic internal view of a DVB-H compliant antenna within a housing according to some embodiments of the invention.

FIG. 2 is a schematic diagram illustrating the interior of a DVB-H compliant antenna accessory housing 230 including a DVB-H compliant antenna 225 coupled to associated supporting circuitry 220 via an antenna feed 221 according to some embodiments of the invention. As shown in FIG. 2, the DVB-H compliant antenna 225 is generally shaped as a pyramid located proximate to an outer wall of the housing 230 to allow sufficient reception of DVB-H compliant signals via the antenna 225. It will be understood that the pyramid shape used to represent the DVB-H compliant antenna 225 is an idealized schematic representation thereof and is not to be construed as an explicit implementation. Moreover, as discussed herein, the DVB-H compliant antenna can be arranged according to other general shapes.

It will be understood that the associated supporting circuitry 220 coupled to the DVB-H compliant antenna 225 can include a DVB-H compliant receiver that is configured to receive DVB-H compliant signals via the antenna 225 and provide digital video broadcast data (such as DVB-H baseband video data) to the wireless terminal 100 via a DVB-H compliant interface provided by the coupling of the connectors 110A/B. It will be understood that the associated supporting circuitry 220 can include other circuitry.

Figure 3:
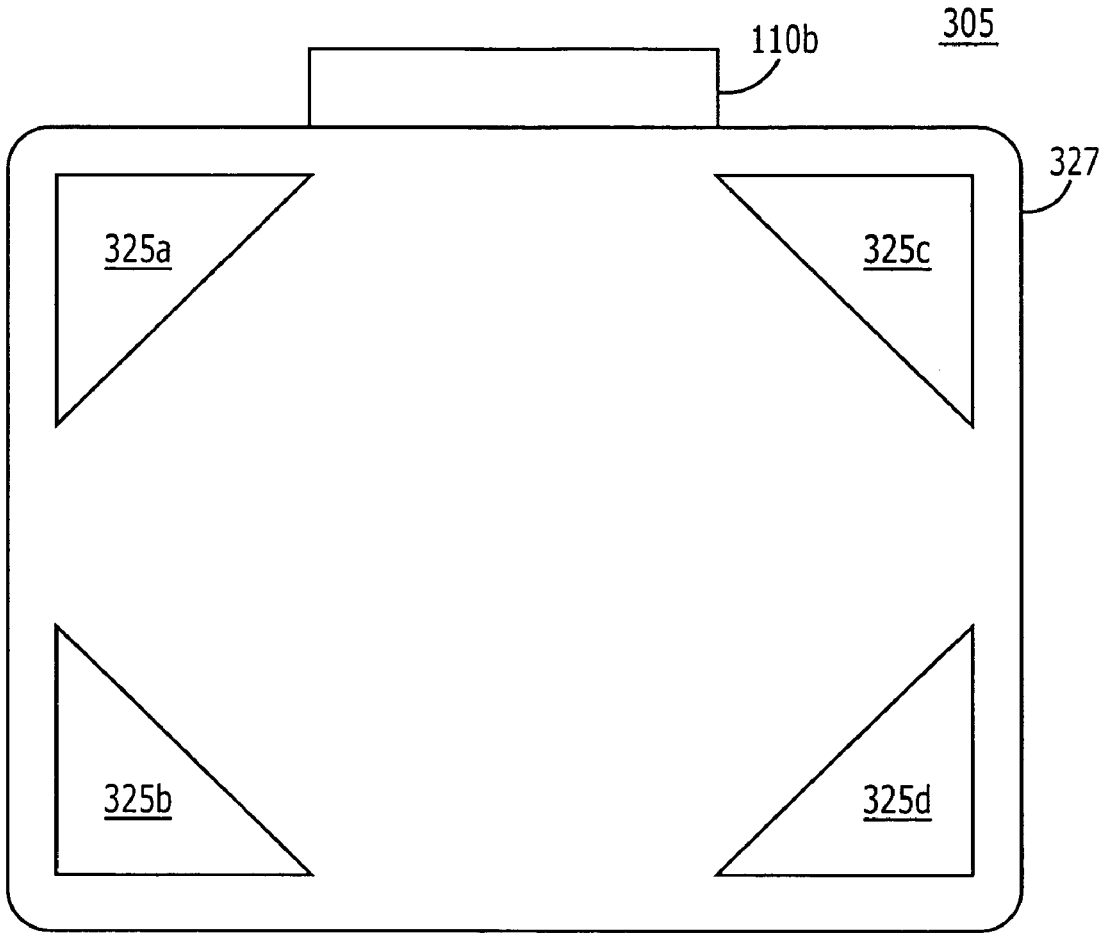
FIG. 3 is a schematic internal view of orientations/locations of DVB-H compliant antennas within a housing according to some embodiments of the invention.

FIG. 3 is a schematic illustration of an interior of the DVB-H compliant antenna accessory 305 including at least one DVB-H compliant antenna 325 according to some embodiments of the invention. As shown in FIG. 3, the DVB-H compliant antenna accessory 305 can include at least one DVB-H compliant antenna 325 A-D that is positioned proximate to an outer wall 327 of the accessory 305. It will be further understood that although four DVB-H compliant antennas 325 are illustrated in FIG. 3, more or fewer antennas may be used. Furthermore, in some embodiments according to the invention, a single DVB-H compliant antenna 325 may be used in any one of the locations proximate the outer wall 327 of the accessory 305. For example, in some embodiments according to the invention, DVB-H compliant antenna 325B may be the only antenna located in the housing at a lower left side thereof. It will be further understood that although the DVB-H compliant antennas are shown in the corners of the accessory 305, antennas may be located in different positions within the housing. In still further embodiments according to the invention, although generalized pyramid shapes are shown for the antennas 325A-D, other shapes may be used. Moreover, in some embodiments according to the invention, a combination of shapes for DVB-H complaint antennas may be used where more than one antenna is included.

Figure 4:
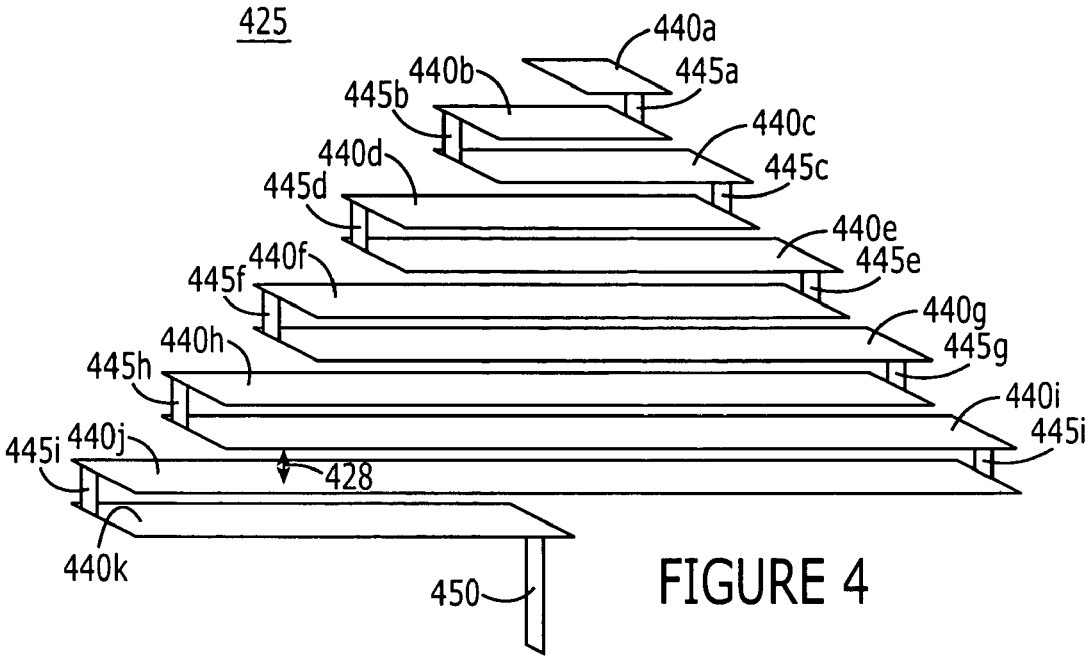
FIG. 4 is a perspective view of a DVB-H compliant multi-plate monopole antenna according to some embodiments of the invention.

FIG. 4 is a perspective view of a multi-plate monopole DVB-H compliant antenna 425 according to some embodiments of the invention. As shown in FIG. 4, each of the plates at least partially overlap each other so that a gap 428 between each of the plates is provided. In some embodiments according to the invention, the gap can be about 0.5 ml to about 2.0 ml. In still other embodiments according to the invention, the gap between the plates can vary.

As further shown in FIG. 4, the plates 440*a-j* of the multi-layered monopole antenna 425 are stacked in descending order according to size from an upper plate 440A toward a feed point 450. Accordingly, in some embodiments illustrated in FIG. 4, the largest one of the plates 440*j* included in the multi-layered monopole antenna 425 is located closest to the feed point 450 whereas the smallest of the plates 440*a* is located farthest from the feed point 450. Although the arrangement of plates shown in FIG. 4 define a generalized pyramid shape, it will be understood that other arrangements can be used to provide different generalized shapes, such as an inverted pyramid, where the feed 450 may be located proximate to the smallest plate 440*a* and the largest plate 440*j* is remote from the feed 450.

Still referring to FIG. 4, conductors 445*a-k* are coupled to alternating shorter edges of each of the plates in the multi-layered monopole antenna 425 so that the plates are coupled-in series with one another. Moreover, because the conductors 445*a-k* couple the relatively shorter edges of the individual plates to adjacent ones thereof, the overall length of the antenna 425 from the feed point 450 to the upper plate 440*a* is provided by the combined lengths of the plates included in the multi-layered monopole antenna 425. In some embodiments according to the invention, the overall length of the antenna 425 can be about three-quarters of a wave length of the operating frequency for which the antenna 425 is to be used. In some embodiments according to the invention, the shorter edge of the plates can be about 6.0 to about 10.0 millimeters long.

Figure 5:
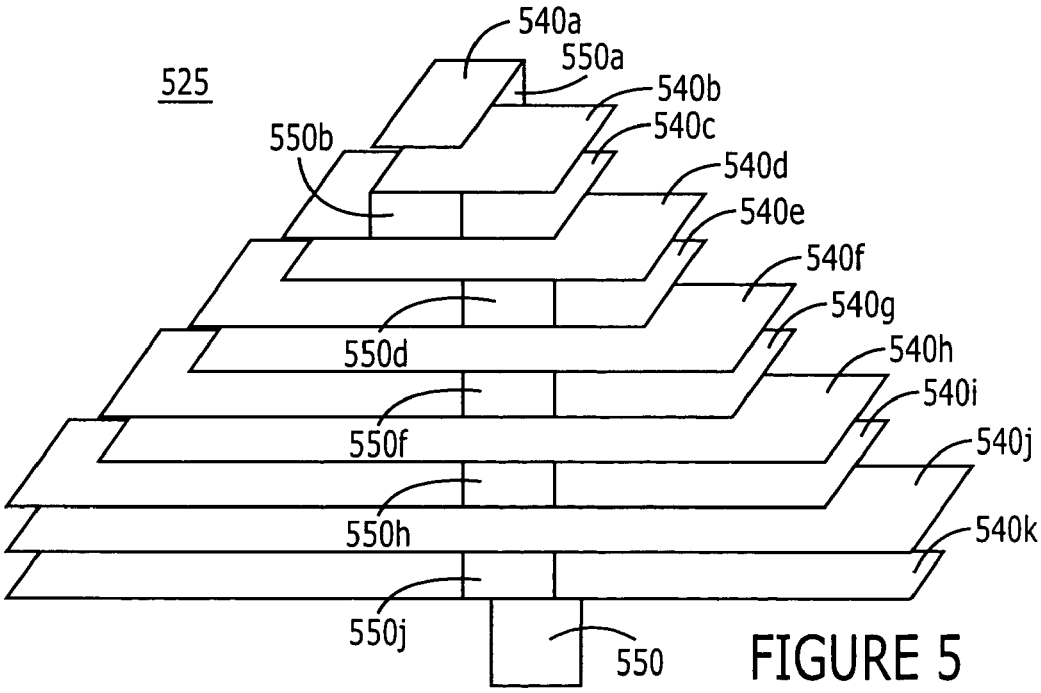
FIG. 5 is a perspective view of a DVB-H compliant multi-plate monopole antenna, according to some embodiments of the invention.

FIG. 5 is a perspective view of a multi-layered monopole antenna 525 according to some embodiments of the invention. According to FIG. 5, the conductors 550*a-h* are coupled to alternating longer edges of each of the plates 540*a-k* in the multi-layered monopole antenna 525 so that the plates are coupled in series with one another. Accordingly, the overall length of the antenna 525 can be the sum of the widths of each of the plates 540*a-k* in the multi-layered monopole antenna 525. It will be understood that not all of the conductors 550 are shown for the sake of simplicity.

It will be understood that the embodiments illustrated by FIGS. 4 and 5 can provide, for example, the DVB-H compliant antenna 225 shown in FIG. 2. In particular, each of the embodiments illustrated in FIGS. 4 and 5 can be oriented within the housing 227 in the same orientation and location as that of the DVB-H compliant antenna so that the plates included in the multi-layered monopole antenna are substantially aligned with the schematic representations of the plates 240 shown in FIG. 2.

It will be further understood that the DVB-H compliant antenna 225 can be formed within a printed circuit board or according to other techniques known to those skilled in the art. For example, antennas according to some embodiments of the invention, may be formed on a dielectric substrate of FR4 or polyimide, by etching a metal layer or layers in a pattern on the dielectric substrate. The antenna can be formed of a conductive material such as copper, such as a copper sheet. Alternatively, the antenna may be formed from a copper layer on the dielectric substrate. It will be understood that antennas according to embodiments of the invention may be formed from other conductive materials and are not limited to copper. Other dielectric materials (such as air) may also be used.

Antennas according to embodiments of the invention may have various shapes, configurations, and/or sizes and are not limited to those illustrated. For example, the invention may be implemented with any micro-strip antenna. Moreover, embodiments of the invention are not limited to multi-layered monopole antennas.

Figure 6:
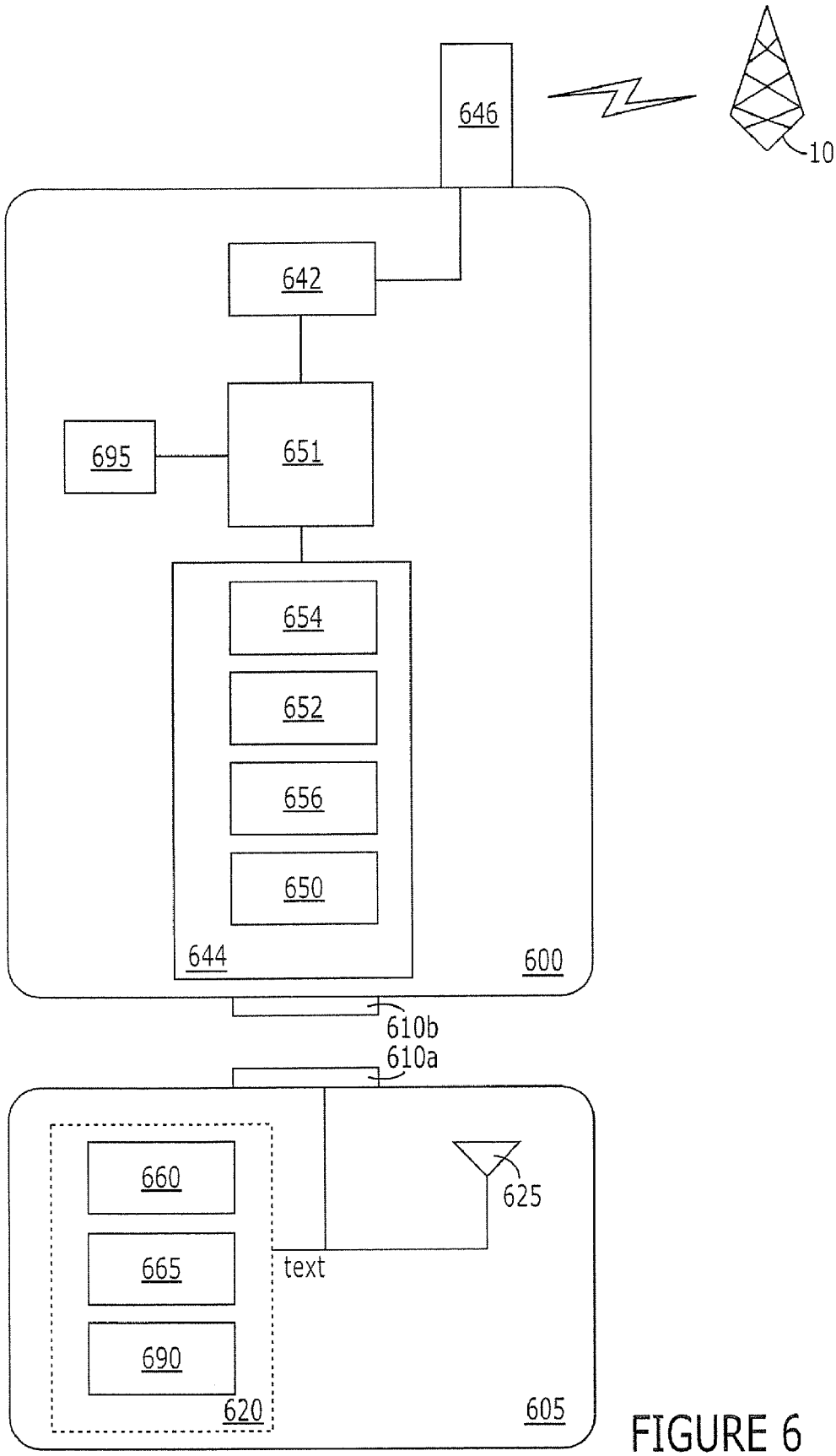
FIG. 6 is a block diagram of a DVB-H compliant antenna accessory with a cellular radiotelephone configured to be removeably coupled to one another according to some embodiments of the invention.

FIG. 6 is a schematic diagram that illustrates a DVB-H compliant antenna accessory 605 configured to be removeably coupled to a cellular radiotelephone 600 according to some embodiments of the invention. As shown in FIG. 6, the accessory 605 includes an antenna 625 that is configured to receive DVB-H compliant signals in frequency range of about 470 MHz to about 860 MHz. In some embodiments according to the invention, the DVB-H compliant antenna 625 is configured to provide RF formatted DVB-H compliant signals to the cellular radiotelephone 600 via a DVB-H compliant connectors 610A/B. The DVB-H compliant data is provided to the cellular radiotelephone 600 for processing and output on a display which is suitable for the display of DVB-H programming.

In other embodiments according to the invention, the accessory 605 further includes associated supporting circuitry 620 such as a DVB-H compliant receiver 660 as well as an I/O circuit 665 and a non-volatile memory 690. In such embodiments according to the invention, the DVB-H compliant antenna 625 may provide the received DVB-H compliant signals to the receiver 660 which may demodulate those signals to provide DVB-H compliant baseband signals to the cellular radiotelephone 600 for further processing and display thereon. The I/O circuitry 665 may include an interface used to configure the receiver circuit 660. The non-volatile memory 690 can be used to store a subscriber identity that can allow the accessory 605 to provide the received DVB-H compliant signals to the cellular radiotelephone 600 if the subscriber identity is valid. For example, in some embodiments according to the invention, the DVB-H services may be provided subject to a subscription, wherein a user may purchase a subscription so that an associated subscriber identity is stored via the non-volatile memory 690.

To facilitate effective performance during reception, the impedance of the DVB-H compliant antenna 625 can be "matched" to an impedance of the receiver 665 to maximize power transfer between the DVB-H compliant antenna 625 and the receiver 665. It will be understood that, as used herein, the term "matched" includes configurations where the impedances are substantially electrically tuned to compensate for undesired antenna impedance components to provide a particular impedance value, such as 50-Ohms (Ω), at the feed of the DVB-H compliant antenna 625.

Upon configuration, the accessory 605 may access the subscriber identity in the non-volatile memory 690 to allow operation of the accessory 605 so that the cellular radiotelephone 600 may ultimately display the DVB-H programming services. Furthermore, the non-volatile memory 690 may include other subscriber identity information that may enable the display of other subscription based services available via the DVB-H services such as individual pay channels that may be broadcast as part of the DVB-H service. In some embodiments according to the invention, the non-volatile memory 690 is a removeable subscriber identity module (i.e., SIM). Other types of non-volatile memory may also be used.

The cellular radiotelephone 600 can also include a non-volatile memory 695 (as an alternative to or in addition to) the non-volatile memory 690 included in the accessory 605. Accordingly, access to DVB-H services may be enabled by the subscriber identity stored in the non-volatile memory 695 rather than or in addition to the subscriber identity stored in the non-volatile memory 690.

As described above, the radiotelephone 600 is also capable of functioning as part of a communications network 10. The radiotelephone 600 can communicate with the wireless communications network 10 via, for example, a Mobile Telephone Switching Center (MTSC). The radiotelephone 600 can also communicate with other terminals via a Public Service Telephone Network (PSTN) that is coupled to the network 10.

The network 10 can transmit/receive data to/from the radiotelephone 600 over an associated control channel that can be used, for example, to page the radiotelephone 600 in response to calls directed thereto or to transmit traffic channel assignments to the radiotelephone 600 over which call associated therewith are to be conducted.

As illustrated in FIG. 6, the radiotelephone 600 includes a transceiver circuit 642 that is operative to transmit and receive radio frequency communication signals to the network 10 via an antenna system 646. The antenna system 646 may include an antenna feed structure and one or more antennas.

As is well known to those of skill in the art, a transmitter portion of the transceiver 642 converts the information, which is to be transmitted by the radiotelephone 600 into electromagnetic signals suitable for radio communications. A receiver portion of the transceiver 642 demodulates electromagnetic signals, which are received by the radiotelephone 600 from the network 10 to provide the information contained in the signals in a format, which is understandable to the user.

A user interface 644 of the radiotelephone 600 may include a variety of components, such as a display 654, a keypad 652, a speaker 656, and a microphone 650, operations of which are known to those of skill in the art. It will be understood that the functions of keypad 652 and the display 654 can be provided by a touch screen through which the user can view information, provide input thereto, and otherwise control the radiotelephone 600.

A processor circuit 651 can provide for overall operation of the radiotelephone 600 including coordination of communications via the transceiver circuit 642, the user interface 644, and other components and systems included in the radiotelephone 600. For example, the processor circuit 651 can provide communications signals to the transceiver circuit 642 when the user speaks into the microphone 650 and receives communications signals from the transceiver 642 for the reproduction of audio through the speaker 656. The processor circuit 651 can generate characters for display on the display 654.

It will be understood that the radiotelephone 600 can support the communication standard developed under the Third Generation Partnership Project (3GPP) and other systems such as CDMA-2000, commonly referred to as Wideband Code Division Multiple Access (WCDMA). These specifications regulate, among other things, various aspects of how mobile user terminals, serviced by a compliant system, should operate. More detail on the operations of 3GPP (or 3G) compliant wireless terminals may be found in the specification documents on the Internet from "3gpp.org", the disclosures of which are incorporated herein by reference as if set forth fully herein.

It will be understood that the radiotelephone 600 can be what is commonly referred to as a stick "form-factor" cellular radiotelephone (i.e., a non-folding radiotelephone), a folding "form-factor" cellular radiotelephone, or a game controller form-factor cellular radiotelephone. As used herein, the term "form-factor" means the physical shape and the typical usage based orientation of the wireless terminal or cellular radiotelephone. For example, the game controller form-factor radiotelephone can be configured for use in a horizontal orientation where fingers of both hands may be used to operate the radiotelephone. In contrast, a stick and folding type form-factor radiotelephones may be configured for use in a vertical orientation.

Figure 7:
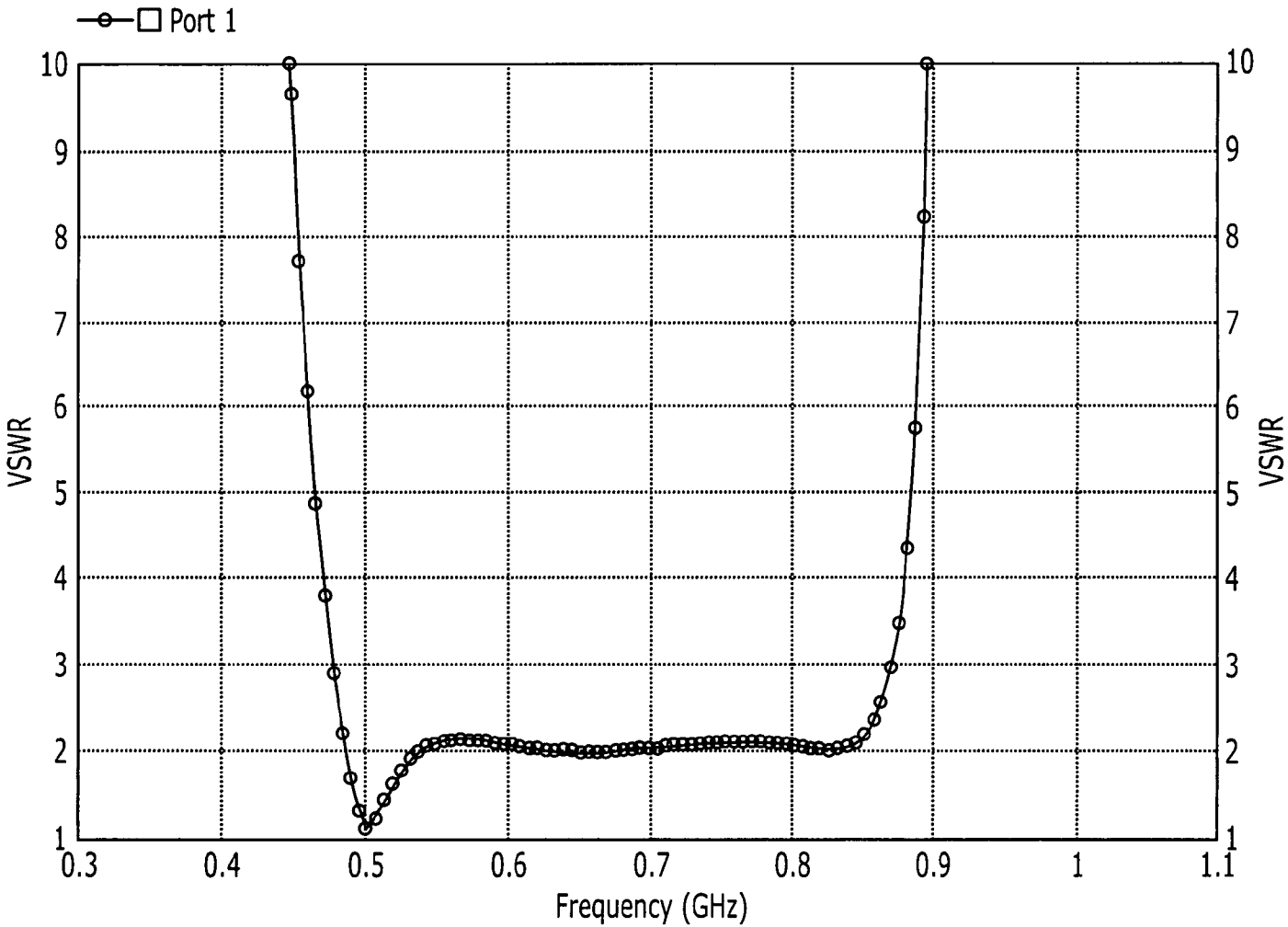
FIG. 7 is a simulation of a voltage standing wave ratio for an exemplary DVB-H antenna according to some embodiments of the invention.

FIG. 7 is a graph that illustrates the voltage standing wave ration (VSWR) that may be provided by a DVB-H compliant antenna according to some embodiments of the invention. In particular, the graph in FIG. 7 illustrates a simulation of a VSWR wherein the antenna is included in an accessory and coupled to a wireless terminal including a ground plane that measures approximately 45 mm by about 100 mm. As shown in FIG. 7, the portion of the graph below the 3:1 markers correspond to a range of about 470 MHz to about 870 MHz.

As will be appreciated by those skilled in the art, a VSWR associated with the DVB-H compliant antenna relates to the impedance match of the antenna with the feed to the receiver. To receive DVB-H compliant electromagnetic RF radiation with a minimum loss, or to provide received RF radiation to the receiver in the wireless terminal with minimum loss, the impedance of the antenna may be matched to the impedance of the transmission line or feed via which electromagnetic RF radiation is provided to/from the DVB-H compliant antenna.

As described above, an antenna accessory for a wireless terminal can include an antenna accessory housing that is configured to be removeably coupled to a wireless terminal configured to display digital video broadcast data on a display thereof. The antenna accessory includes a digital video broadcast handheld (DVB-H) compliant antenna in the housing and is configured to receive DVB-H compliant signals. Accordingly, a suitably sized DVB-H compliant antenna can be provided in the housing of the antenna accessory rather than in the wireless terminal. As appreciated by the present inventor, the limited space available within the housing of a typical wireless terminal may be so limited that it may be difficult to provide an adequately sized and positioned DVB-H compliant antenna within the wireless terminal without creating an unappealing size as defined by users. Therefore, an antenna accessory according to some embodiments of the invention may be coupled to a wireless terminal when DVB-H compliant services are to be accessed and may be de-coupled when, for example, the wireless terminal is to be used in another capacity such as for cellular radiotelephone communications.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

What is claimed:

1. An antenna accessory for a wireless terminal comprising:

an antenna accessory housing configured to be removably electrically coupled to a wireless terminal configured for display of digital video broadcast data;

a Digital Video Broadcast-Handheld (DVB-H) compliant multi-plate monopole antenna in the antenna accessory housing configured to receive DVB-H compliant signals; and a DVB-H compliant receiver in the antenna accessory housing configured to receive the DVB-H compliant signals and provide digital video broadcast data from the DVB-H compliant signals to the wireless terminal, wherein the multi-plate monopole antenna comprises a plurality of at least partially overlapping plates electrically coupled together in series via a plurality of conductors coupled to respective edges of the at least partially overlapping plates and the plurality of conductors are coupled to a combination of shorter and longer edges of the at least partially overlapping plates.

2. An antenna accessory according to claim 1 wherein the wireless terminal is configured to provide wireless communications with the antenna accessory de-coupled therefrom.

3. An antenna accessory according to claim 1 wherein the wireless terminal comprises a "stick" or "clam-shell" form-factor wireless terminal.

4. An antenna accessory according to claim 1 wherein the DVB-H compliant antenna comprises a multi-plate monopole antenna.

5. An antenna accessory according to claim 1 further comprising:

a plurality of conductors coupled to alternating edges of the at least partially overlapping plates.

6. An antenna accessory according to claim 5 wherein the alternating edges comprise alternating shorter edges compared to an adjacent edge of the plurality of the at least partially overlapping plates.

7. An antenna accessory according to claim 5 wherein the alternating edges comprise alternating longer edges compared to an adjacent edge of the plurality of the at least partially overlapping plates.

8. An antenna accessory according to claim 1 wherein the DVB-H compliant antenna is located proximate an outer wall of the antenna accessory housing.

9. An antenna accessory according to claim 1 further comprising:

an antenna feed coupled to a first one of the plurality of the least partially overlapping plates, wherein remaining ones of the plurality of the least partially overlapping plates are arranged above the first one according to increasingly larger sizes of the plurality of the least partially overlapping plates to define a pyramid shape for the plurality of the least partially overlapping plates.

10. An antenna accessory according to claim 1 further comprising:

an antenna feed coupled to a first one of the plurality of the least partially overlapping plates, wherein remaining ones of the plurality of the least partially overlapping plates are arranged above the first one according to decreasingly smaller sizes of the plurality of the least partially overlapping plates to define an inverted pyramid shape for the plurality of the least partially overlapping plates.

11. An antenna accessory according to claim 1 further comprising:

an antenna feed coupled to a first one of the plurality of the least partially overlapping plates, wherein remaining ones of the plurality of the least partially overlapping plates are arranged above the first one.

12. An antenna accessory according to claim 1 wherein the plurality of at least partially overlapping plates include opposing faces that are spaced about 0.5 mm to about 2.0 mm apart.

13. An antenna accessory according to claim 12 wherein the spacing between opposing face of the plurality of at least partially overlapping plates is unequal.

14. An antenna accessory according to claim 1 further comprising:

a non-volatile memory configured to store a DVB-H services subscriber identity.

15. An antenna accessory according to claim 14 wherein the non-volatile memory comprises a semiconductor based non-volatile memory and/or a subscriber identity module.

16. An antenna accessory according to claim 1 wherein the DVB-H compliant antenna is configured to receive DVB-H signals in a range of about 470 Mhz to about 860 Mhz.

17. An antenna accessory according to claim 1 wherein the wireless terminal comprises a cellular radiotelephone.

18. An antenna accessory according to claim 1 wherein the wireless terminal comprises a game "controller" form-factor wireless terminal.

19. An antenna for a wireless terminal comprising:

a Digital Video Broadcast-Handheld (DVB-H) compliant antenna configured to receive DVB-H compliant signals comprising a multi-plate monopole antenna, the antenna further comprising a plurality of at least partially overlapping plates electrically coupled together in series via a plurality of conductors coupled to respective edges of the at least partially overlapping plates and the plurality of conductors are coupled to a combination of shorter and longer edges of the at least partially overlapping plates.

20. An antenna according to claim 19 further comprising:

a plurality of conductors coupled to alternating edges of the at least partially overlapping plates.

21. An antenna according to claim 20 wherein the alternating edges comprise alternating shorter edges compared to an adjacent edge of the plurality of the at least partially overlapping plates.

22. An antenna according to claim 20 wherein the alternating edges comprise alternating longer edges compared to an adjacent edge of the plurality of the at least partially overlapping plates.

23. An antenna according to claim 19 wherein the DVB-H compliant antenna is located proximate an outer wall of the wireless terminal.

24. An antenna according to claim 19 further comprising:

an antenna feed coupled to a first one of the plurality of the least partially overlapping plates, wherein remaining ones of the plurality of the least partially overlapping plates are arranged above the first one according to increasingly larger sizes of the plurality of the least partially overlapping plates to define a pyramid shape for the plurality of the least partially overlapping plates.

25. An antenna according to claim 19 further comprising:

an antenna feed coupled to a first one of the plurality of the least partially overlapping plates, wherein remaining ones of the plurality of the least partially overlapping plates are arranged above the first one according to decreasingly smaller sizes of the plurality of the least partially overlapping plates to define an inverted pyramid shape for the plurality of the least partially overlapping plates.

26. An antenna according to claim 19 further comprising:

an antenna feed coupled to a first one of the plurality of the least partially overlapping plates, wherein remaining ones of the plurality of the least partially overlapping plates are arranged above the first one.

27. An antenna according to claim 19 wherein the plurality of at least partially overlapping plates include opposing faces that are spaced about 0.5 mm to about 2.0 mm apart.

28. An antenna according to claim 27 wherein the spacing between opposing face of the plurality of at least partially overlapping plates is unequal.

* * * * *